US005669349A

United States Patent [19]

Iwata et al.

[11] Patent Number: 5,669,349

[45] Date of Patent: Sep. 23, 1997

[54] ENGINE CONTROL SYSTEM FOR MARINE PROPULSION

[75] Inventors: Yoshifumi Iwata; Akihiko Hoshiba; Sadato Yoshida; Masaru Suzuki, all of Hamamatsu, Japan

[73] Assignee: Sanshin Kogyo Kabushiki Kaisha, Hamamatsu, Japan

[21] Appl. No.: 589,657

[22] Filed: Jan. 22, 1996

[30] Foreign Application Priority Data

Jan. 23, 1995 [JP] Japan ..... 7-027346

[51] Int. Cl.[6] ..... F01N 3/28

[52] U.S. Cl. ..... 123/335; 123/196 S; 123/198 D

[58] Field of Search ..... 123/196 S, 198 D, 123/332, 333, 334, 335, 394, 479

[56] References Cited

U.S. PATENT DOCUMENTS 3,602,207 8/1971 Kilmer ..... 123/198 D X 4,726,798 2/1988 Davis ..... 123/335 X 4,945,879 8/1990 Fujimoto et al. ..... 123/198 D X

*Primary Examiner*—Tony M. Argenbright

*Attorney, Agent, or Firm*—Knobbe, Martens Olson & Bear LLP

[57] ABSTRACT

A marine propulsion system and particularly an outboard motor wherein the outboard motor is provided with a control for preventing engine damage in response to an abnormal condition by reducing the speed of the engine through disabling certain cylinders. The cylinders disabled are chosen on the vertical position of the cylinder in the engine so as to provide improved running and avoid undesirable results. In addition, the disabling of the cylinders is precluded until the abnormal condition has existed more than a predetermined time period upon initial start-up so as to permit unencumbered normal warm up of the engine.

50 Claims, 14 Drawing Sheets

Cylinders 1 & 4
Disabled

Cylinders 2 & 3
Disabled

ENGINE CONTROL SYSTEM FOR MARINE PROPULSION

BACKGROUND OF THE INVENTION

This invention relates to an engine control system for marine propulsion and more particularly to an improved engine and control system and method for protecting the engine from damage in the event of abnormal conditions.

In a wide variety of engine applications, it has been the practice to provide a control which protects the engine from damage in the event of certain abnormal conditions. Rather than completely stopping the engine, however, the engine is permitted to continue to operate, but at a reduced speed so as to prevent damage to the engine. When the engine is employed in a vehicle, it is not desirable to completely disable the engine in the event of an abnormal condition as this may leave the vehicle and its operator and passenger or passengers stranded. By operating the engine at a reduced speed it is still possible for the vehicle to reach a safe location where repair can be made. Of course, in extreme conditions it may be necessary to stop the engine.

One way in which the engine speed is reduced is to disable the operation of one or more cylinders. This may be done by misfiring the spark plugs and/or cutting off the fuel supply.

In many of these types of systems, the cylinder or cylinders which are disabled from combustion are chosen in such an order so as to maintain substantially even firing intervals. By doing this, it is possible to ensure that smooth results. However, in some engine applications other factors may be more important in determining which cylinders are disabled.

A primary example of this is in conjunction with marine propulsion systems. With marine propulsion systems, it is a common practice to discharge the exhaust gases from the engine not directly to the atmosphere, particularly under high speed, high load conditions. Rather, the exhaust gases are discharged through an underwater exhaust discharge system. By utilizing the underwater exhaust discharge, it is possible to effect some silencing through this discharge mode. This is particularly important in conjunction with marine propulsion applications. These applications does not offer the length or space in order to provide adequate silencing in the exhaust system itself as with the other application.

The use of the underwater exhaust gas discharge, however, gives rise to added back pressure under some running conditions. Although some of this may be alleviated through the use of supplemental above the water exhaust gas discharges, these discharges still are designed to provide some back pressure in order to achieve silencing of the atmospherically discharged exhaust gases.

These problems are further amplified by the fact that marine propulsion systems generally provide only one or two discharge outlets each of which serves a number of cylinders. Because of this arrangement, and this problem is particularly acute in conjunction with outboard motors, the effect of exhaust pressure is different on one cylinder than on others. This is particularly true in conjunction with outboard motors wherein the cylinders are disposed generally vertically one above the other with their cylinder bores extending horizontally. The different distances between the cylinders and the exhaust discharge and the vertical displacement of the cylinders can cause uneven running.

Although these problems are prevalent in two-cycle engines where exhaust pulse back can have significant effect on the engine, they also exist in four-cycle engines it has been discovered.

Therefore, it is a principle object of this invention to provide an improved engine protection system for providing speed control in the event of abnormal conditions but wherein the cylinders selected are chosen so as to assist in the ease of engine operation and avoid additional problems.

It is a further object of this invention to provide an engine control system and method wherein engine speed is controlled by disabling the firing of certain particular cylinders. The cylinders disabled are chosen depending upon their vertical positioning in the power head of the outboard motor.

In conjunction with the disabling of operation of certain cylinders, if the other cylinder controls are left unchanged, engine running may not be optimum. That is, if cylinders are disabled from firing, it may be desirable to change the way in which the other cylinders are fired. For example, better engine operation may result when certain cylinders are disabled if the timing of the firing of the remaining cylinders is altered.

It is, therefore, a further object of this invention to provide an improved engine control system and methodology wherein the engine speed is reduced by disabling the firing of certain cylinders and the operation of other cylinders is adjusted when this is done.

Although it is generally desirable to reduce the speed of the engine when an abnormal condition may be determined to exist in order to prevent difficulties, there are times when it may not be desirable to reduce the speed of the engine automatically and immediately upon the sensing of the undesirable condition. For example, during start-up and initial warm-up of the engine, signals may be given indicative of an abnormal condition but the signals need not necessarily actually indicate a true abnormal condition due to the warm-up situation of the engine.

It is, therefore, a still further object of this invention to provide an improved engine control system and method wherein the disabling of firing of certain cylinders in response to the sensing of an abnormal condition is delayed during initial start-up unless the situation exists for more than a predetermined time period.

It is a further object of this invention to provide an improved way of warming up a cold engine.

SUMMARY OF THE INVENTION

First features of this invention are adapted to be embodied in an engine and control system and methodology for an outboard motor. The engine has a plurality of cylinders each extending horizontally and which are disposed in vertically spaced relationship. An air fuel charging system supplies an air fuel charge to the engine for combustion in the cylinders. An ignition system is provided for igniting the fuel air charge in the cylinder. Each of the cylinders has at least an exhaust port and an exhaust system collects the exhaust gases from the exhaust ports and delivers them to the atmosphere through a common discharge. The engine is provided with an engine protection system which includes a sensor for sensing an abnormal engine condition. A system control reduces the engine speed in response to the sensing of the abnormal condition by controlling one of the systems for precluding combustion in certain of these cylinders.

In an engine practicing this invention, the control is configured so as to base its determination on the cylinder or cylinders which are disabled based upon factors that include the vertical position of the cylinders in the engine.

In accordance with a method for practicing the invention, the decision of which cylinder or cylinders are disabled are based in part on the vertical orientation of the cylinders.

Another feature of the invention is also adapted to be embodied in an engine and control system for an internal combustion engine having a plurality of cylinders. The engine is provided with an air fuel charging system for supplying an air fuel charge to the engine for combustion in the cylinders. An ignition system is provided for igniting the air fuel charge in the cylinders. Means are also provided for starting the engine. The engine is provided with an engine protection system that is comprised of a sensor for sensing an abnormal condition and a sensing control for reducing the engine speed in response to the sensing of an abnormal condition by controlling one of the systems for precluding combustion in certain of the cylinders.

In accordance with an engine and control system for practicing this feature of the invention, a timer is provided for determining the time after which the engine has initially been started. If the engine is in initial starting mode, the immediate reduction of engine speed upon the sensing of the abnormal condition by the sensor is not initiated. Rather, if the engine speed is higher than a predetermined speed for a predetermined time period after starting, then the engine speed is reduced by precluding combustion in certain of the cylinders.

In accordance with a method for practicing this feature of the invention, upon initial starting of the engine, if the engine speed is to be reduced because it is more than a predetermined speed, the actual speed reduction is deferred until the engine speed has been above the desired engine speed for more than a predetermined time.

DETAILED DESCRIPTION OF THE PREFERRED EMBODIMENT

Figure 1:
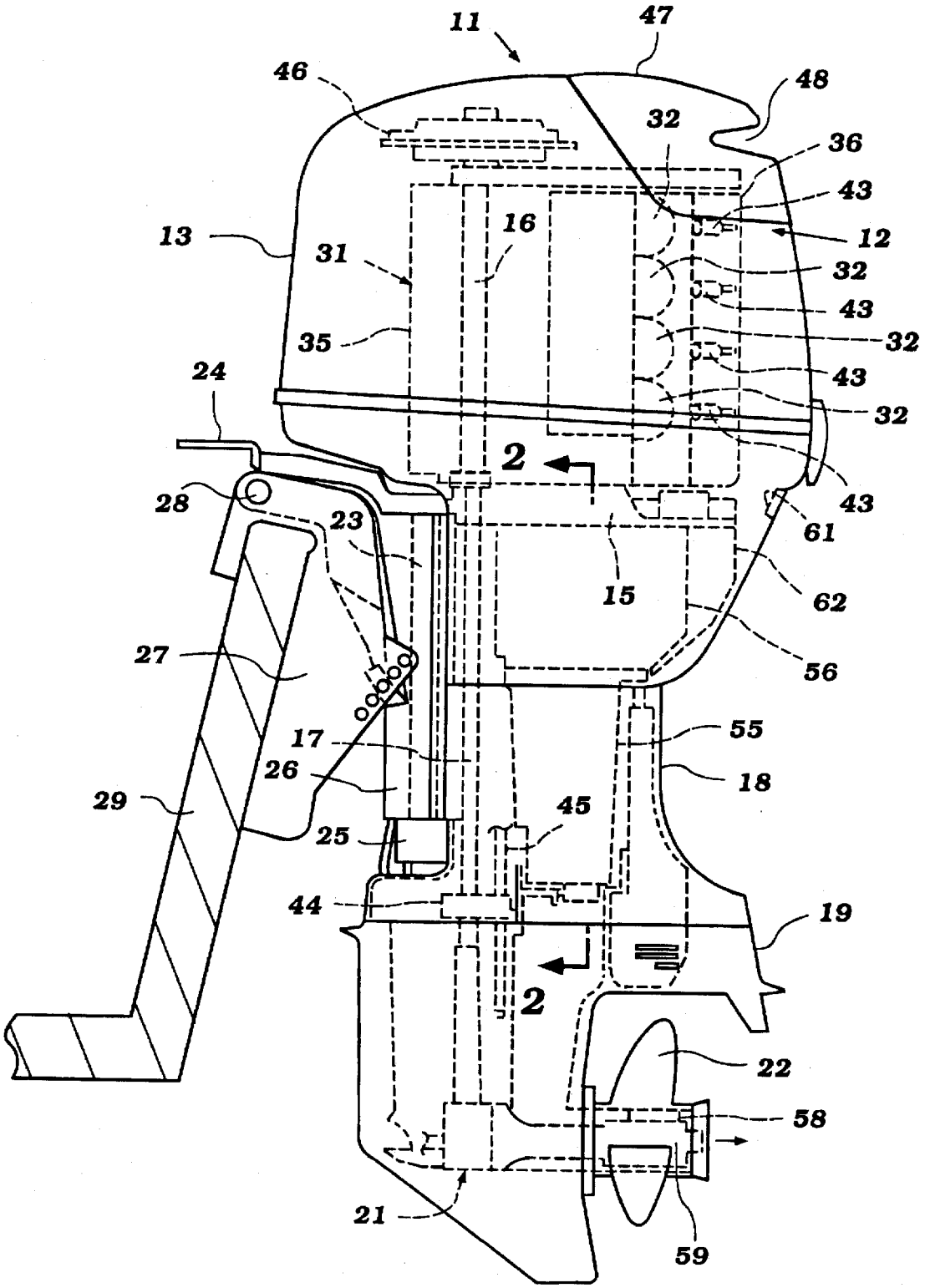
FIG. 1 is a side elevational view of an outboard motor constructed in accordance with an embodiment of the invention with the engine, propulsion system, and exhaust system shown in phantom.
Figure 2:
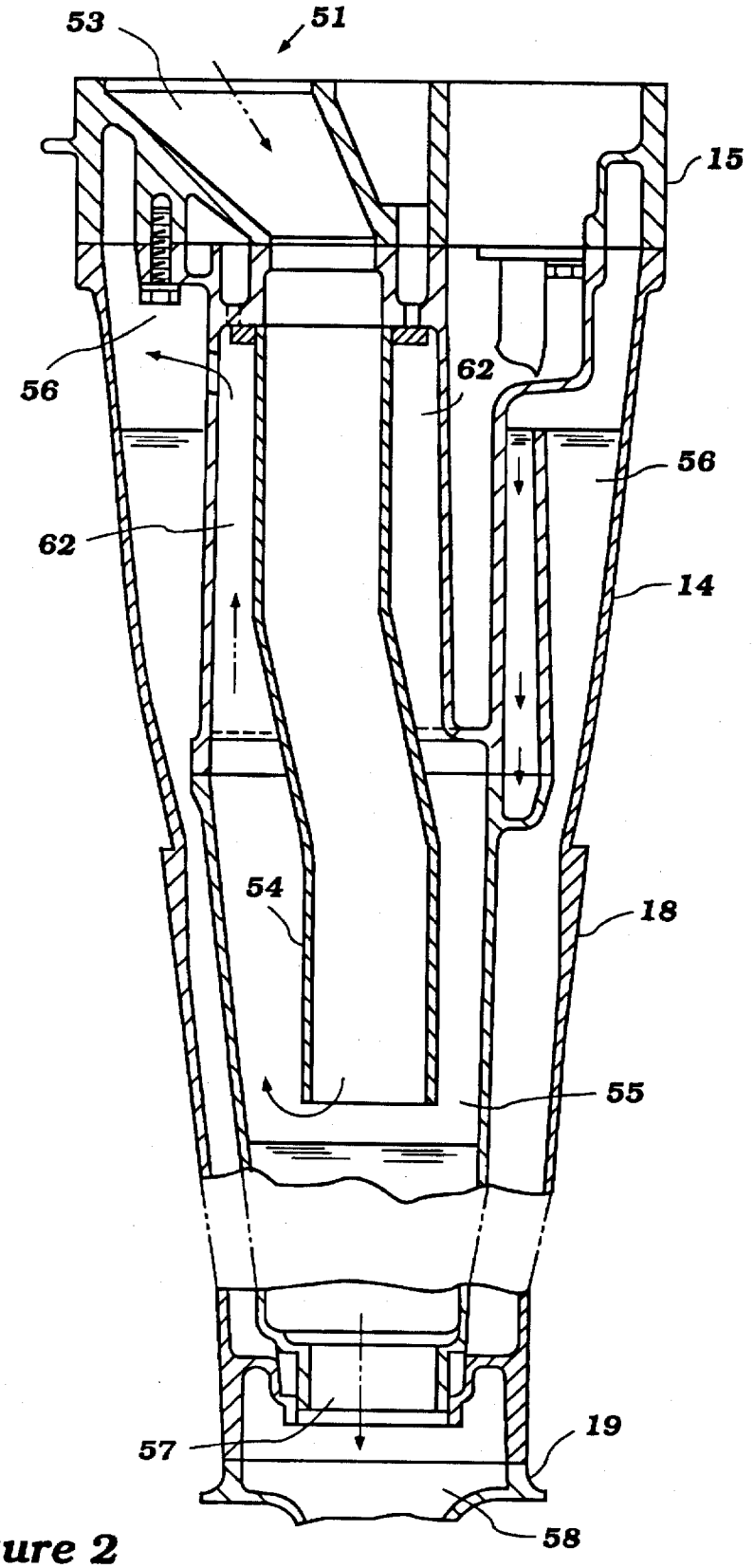
FIG. 2 is a cross sectional view taken along line 2—2 of FIG. 1 and shows a portion of the engine's exhaust system.
Figure 3:
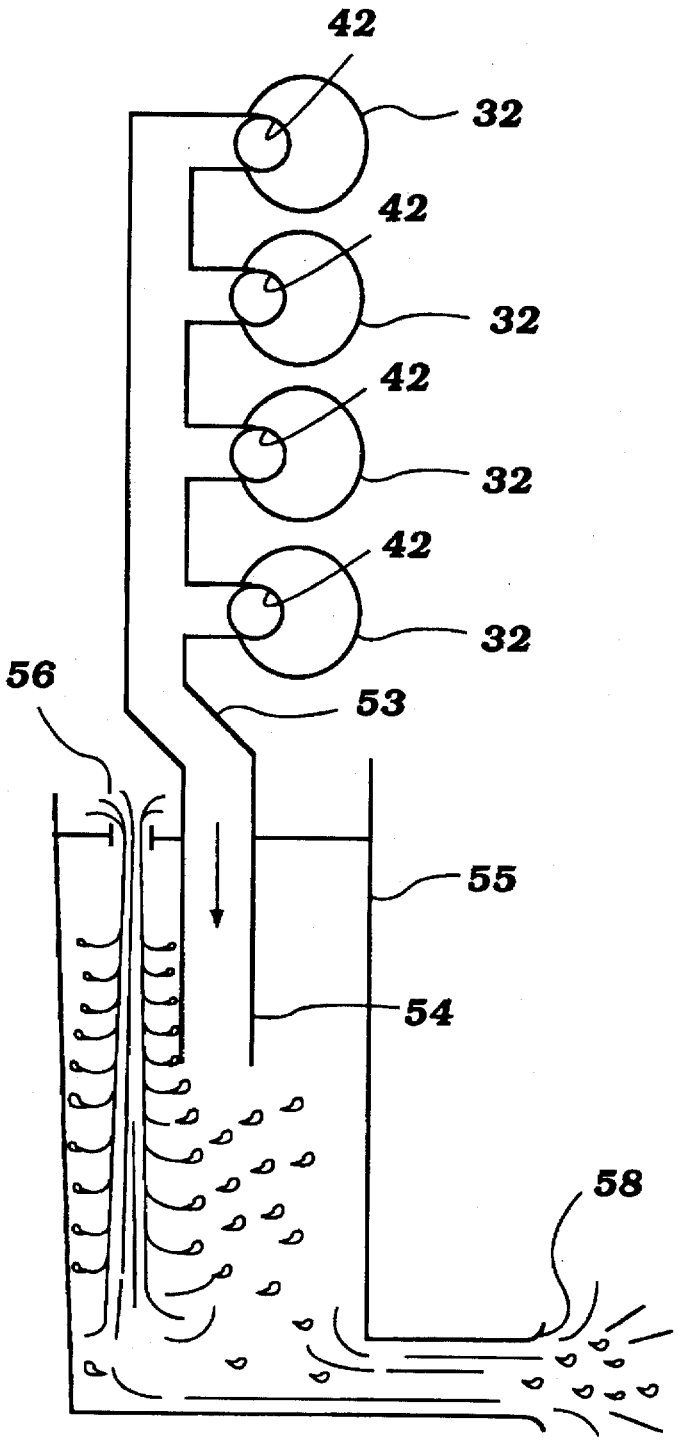
FIG. 3 is a schematic illustration of the engine's exhaust system.

Referring now to the drawings and initially to FIGS. 1 and 2, an outboard motor constructed in accordance with an embodiment of the invention is identified generally by the reference numeral 11. The outboard motor 11 is comprised of a power head that includes a powering internal combustion engine 12. The engine 12 is surrounded by a protective cowling that is comprised of a main cowling portion 13 that is detachably connected to a tray portion 14. A guide plate 15 is connected to the tray 14 and to which the engine 12 is mounted in any suitable manner.

As is typical with outboard motor practice, the engine 12 is supported within the power head so that its output shaft, a crankshaft indicated by the reference numeral 16, rotates about a vertically extending axis. This crankshaft 16 is rotatably coupled to a drive shaft 17 that depends into and is journaled within a drive shaft housing 18. The tray 14 encircles the upper portion of the drive shaft housing 18.

The drive shaft 17 continues on into a lower unit 19 where it is coupled to a conventional, forward reverse bevel gear transmission 21 which, in turn, is coupled to a propeller 22 for driving the propeller 22 in selected forward or reverse directions so as to so propel an associated watercraft.

A steering shaft 23 having a tiller 24 affixed to its upper end is affixed in a suitable manner by means which include a lower bracket assembly 25 to the drive shaft housing 18. This steering shaft 23 is journaled within a swivel bracket 26 for steering of the outboard motor 11 about a vertically extending axis defined by the steering shaft 23.

The swivel bracket 26 is, in turn, connected to a clamping bracket 27 by means of a trim pin 28. This pivotal connection permits tilt and trim motion of the outboard motor 11 relative to the associated transom 29 of the powered watercraft. The trim adjustment permits variation of the angle of attack of the propeller 22 to obtain optimum propulsion efficiency. In addition, the outboard motor 11 may be tilted up to and out of the water position for tailoring and other purposes as is well known in this art.

Figure 7:
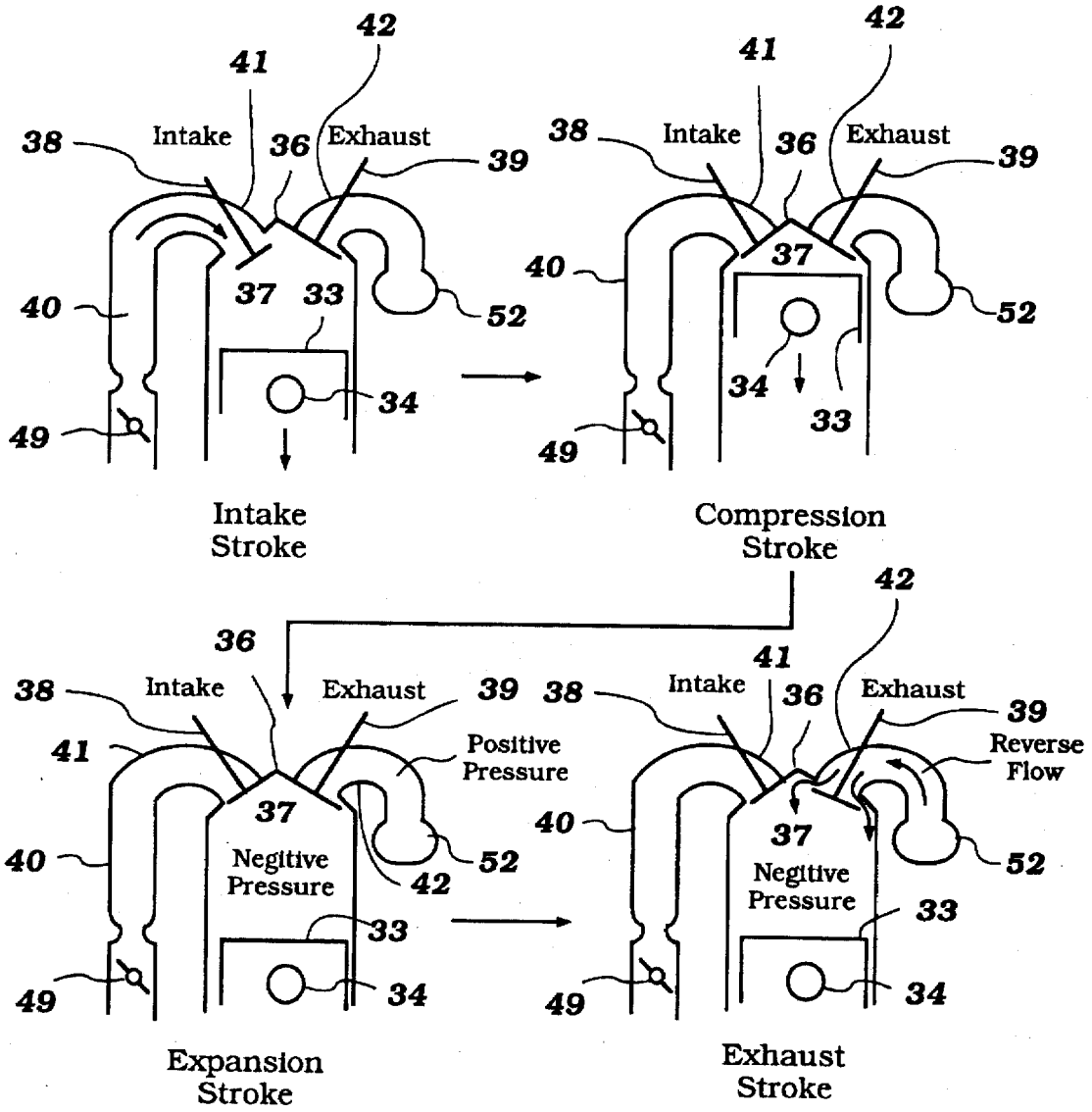
FIG. 7 is a schematic cross sectional view that shows a single combustion cycle for a disabled cylinder.
Figure 8:
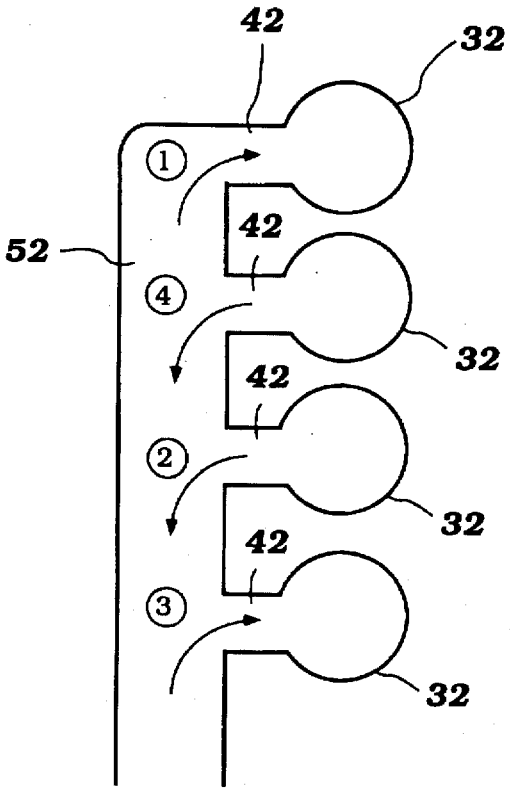
FIG. 8 is a schematic cross sectional view of a portion of the engine and exhaust system.
Figure 8:
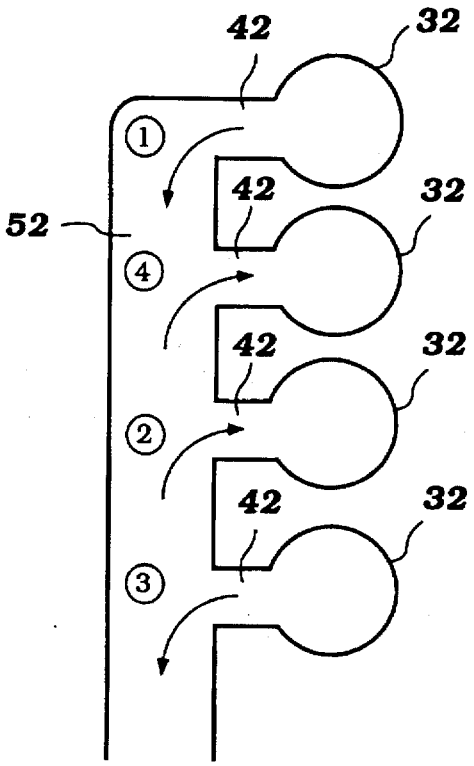

The engine 12 is now described in detail with additional reference to FIGS. 7 and 8. The engine 12 is, in the illustrated embodiment, of the four-stroke, four-cylinder in-line type configuration. To this end, the engine 12 is provided with an engine block 31 in which four horizontally extending parallel cylinder bores 32 are formed in a vertically spaced relationship with each other, with the topmost cylinder 32 being referred to as the number 1 cylinder and the lowermost cylinder 32 being referred to as the number 4 cylinder, while the cylinders immediately adjacent to the numbers 1 and 4 cylinders, respectively are referred to as the numbers 2 and 3 cylinders.

Although the invention is described in conjunction with a four-cylinder, in-line engines it will be readily apparent to those skilled in the art how the invention may be utilized with engines having various cylinder numbers and cylinder configurations and how it may also be used in conjunction with two stroke engines.

As seen schematically in FIG. 7, a piston 33 reciprocates within each cylinder bore 32 and is connected to a connecting rod (not shown) by means of a piston pin 34. The lower or big ends of the connecting rods are journaled on respective throws of the crankshaft 16 which is rotatably journaled within the lower portion of the engine block 31, namely the crankcase chamber 35. The ends of the cylinder bores 32 opposite the crankcase chamber 35 are closed by means of a cylinder head assembly that is indicated by the reference numeral 36, and affixed to the engine block 31 in any known manner.

The cylinder head 36 has recesses 37 which cooperate with the cylinder bores 32 and the heads of the pistons 33 to form combustion chambers. Intake and exhaust valves 38 and 39, respectively, control intake and exhaust ports 41 and 42 which are formed in the cylinder head 36 above the combustion chambers 37. The intake and exhaust valves 38 and 39 are operated in any known manner.

Figure 4:
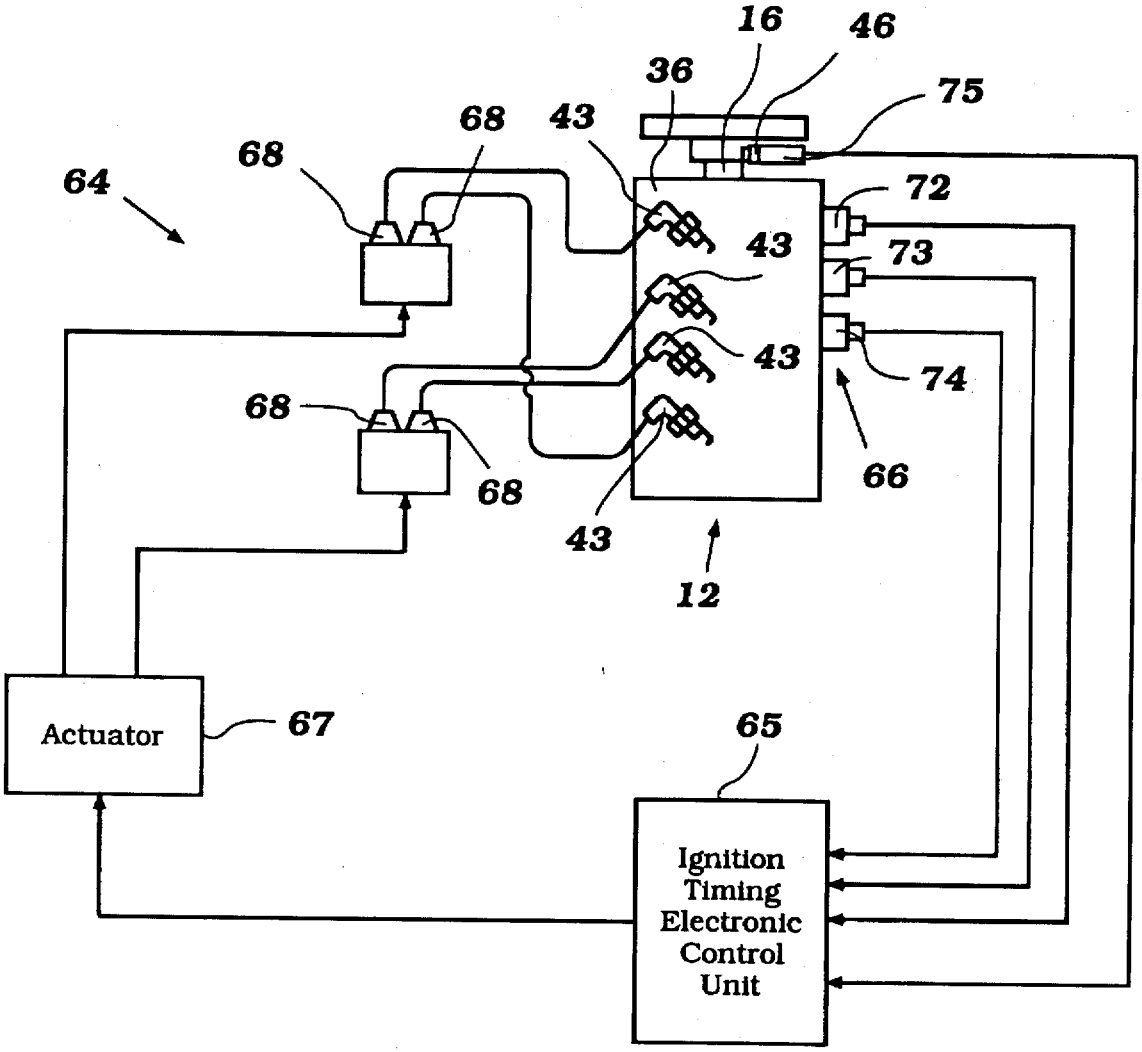
FIG. 4 is a schematic view of the outboard motor which shows the ignition control system.

As seen in FIGS. 1 and 4, spark plugs 43 are disposed in the cylinder head 36 and have their gaps extending into the respective combustion chambers 37 and are fired by an ignition control system that will be discussed in detail later. Since the invention deals primarily with the engine control and control mode, further details of the basic engine construction are not necessary to enable those skilled in the art to practice the invention.

The engine 12 is water cooled and has disposed within the engine block 31 and cylinder head 36 a number of water jackets (not shown). As is commonly practiced in the art, the water jackets receive a supply of cooling water from the body of water in which the outboard motor 11 is operating. This coolant enters the motor 12 through an opening formed in the drive shaft housing lower unit 19 where it is pumped by a pump 44 through a conduit 45 which connects to the water jackets of engine block 12.

A flywheel magneto indicated by the reference numeral 46 is positioned on the upper portion of the engine 12 and is coupled to the crankshaft 16. This flywheel magneto supplies electrical power for the ignition system of the engine 12. The flywheel magneto may also be used to charge a battery or operate electrical accessories of the engine 12 and of the associated watercraft.

An air fuel charge is delivered to the engine's combustion chambers 37 for compression and ignition therein by means of an air fuel charging system (not shown) that is disposed within the protective cowling 16 of the power head and which draws air from the atmosphere through an inlet portion 47 in which is formed an opening 48 of the main cowling member 13. Fuel is supplied to the air fuel charging system from a fuel tank that is not shown.

A charge former (not shown) mixes the fuel and the air in a ratio suitable for combustion and delivers the fuel/air charge through the respective runners 40, in which are positioned throttle valves 49 for controlling the amount of charge used in each combustion cycle. The charge is delivered to each of the cylinders 32 through the respective intake ports 41.

When the spark plugs 43 fire, the charge in the combustion chambers 37 will ignite, burn, and expand. This expanding charge drives the pistons 33 downwardly to drive the crankshaft 16 in a well-known manner. The exhaust gas combustion products are then discharged through the exhaust ports 42 which communicate with an exhaust system that is indicated by the reference numeral 51.

The exhaust system 51 will now be described in detail with reference to FIGS. 1, 2, 3, 7 and 8. An exhaust manifold 52 is connected to the exhaust ports 42 of the engine 12 and extends downwardly to terminate at a generally downwardly facing exhaust discharge passage 53 that is formed in the guide plate portion 15 of the tray 14 and upon which the engine 12 is mounted. The discharge passage 53 delivers the exhaust gases to an exhaust pipe 54 that depends into the drive shaft housing 18.

The drive shaft housing 18 defines an expansion chamber 55 in which the exhaust pipe 54 terminates and into which the engine coolant drains from a coolant discharge passage 56 which receives a supply of heated coolant from the engine's water jackets.

From the expansion chamber 55, the coolant and exhaust gases pass through a common passage 57 and are discharged from the outboard motor 11 through a common discharge 58 that is below the level of the water in which the watercraft is operating and which discharges through the hub 59 of the propeller 22 in a manner well known in this art.

At lower speed when the propeller 22 is more deeply submerged, the exhaust gases may exit to the atmosphere by means of an above water exhaust gas discharge 61 that is formed in the rearward upper portion of the tray 14 and communicates with the expansion chamber 55 by means of an atmospheric exhaust cavity 62 through which the exhaust pipe 54 runs.

The ignition control system will now be discussed with reference to FIG. 4. The ignition control system is indicated by the reference numeral 64 and consists of a closed loop electronic control system in which the firing of the spark plugs 43 is controlled by an ignition timing electronic control unit that is indicated by the reference numeral 65 and which receives signals from a plurality of sensors 66 whose function will be described in detail later. The ignition timing electronic control unit 65 signals an actuator 67 which in turn activates the four ignition coils 68, each of which is associated with a cylinder 32, and fires the spark plugs 43.

As is seen in this figure, the coils 68 are grouped in pairs with the upper pair of ignition coils 68 firing the spark plugs 43 in the numbers 1 and 4 cylinders and the lower pair of ignition coils 68 firing the numbers 2 and 3 cylinder spark plugs 43.

It is possible for the engine 12 to be operated under conditions that could cause damage to the engine 12. For example, the engine 12 could be damaged if operated at high speeds with little or no lubricating oil as could be caused by a lubricating system failure resulting in low oil pressure or by a low oil level. Also if the engine overheats for any reason damage might occur, particularly if the engine speed is high.

While it is of course desirable to discontinue operation of the engine 12 until such abnormal conditions can be corrected or repaired, this is not always advisable as it may result in the operator and any passengers of the vehicle powered by the outboard motor 11 being stranded. An embodiment of this convention addresses these issues by employing an engine protection system which permits the engine 12 to continue operation with reduced engine speed and with combustion precluded by the ignition control system 64 in one or more cylinders 32 when an abnormal engine condition is detected.

With reference once again to FIG. 4, the plurality of sensors 66 are disposed along the engine 12 and signal the ignition timing electronic control unit 65. An engine overheat sensor is indicated by the reference numeral 72 and outputs a signal to the ignition timing electronic control unit 65 when the engine 12 is operating at a temperature in excess of the maximum allowable temperature. An oil pressure sensor 73 signals the ignition timing electronic control unit 65 when the engine oil pressure is above or below the allowable range. An oil level sensor 74 outputs a signal to the ignition timing electronic control unit 65 when the oil level is below the allowable level. Lastly, an engine speed sensor 75 is positioned on the starter 46 and associated with the crankshaft 16 and outputs a signal that is indicative of the engine speed to the ignition timing electronic control unit 65.

Upon detection of any abnormal running conditions by one or more of the sensors 66, the ignition control system 64 will reduce the engine speed for the engine 12 to a predetermined reduced operation running speed. This is performed by the ignition timing electronic control unit 65 which curtails ignition in one or more of the cylinders 32. If this measure is insufficient in reducing the engine speed to the desired level, the ignition timing electronic control unit 65 will curtail ignition in further cylinders 32 until a sufficient engine speed reduction is achieved.

Figure 5:
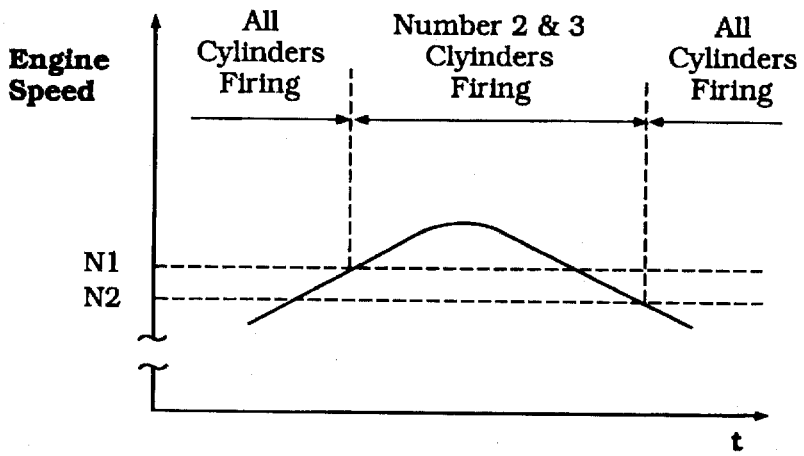
FIG. 5 is a graphical view that shows how the engine speed varies with time during a time range of ignition control.
Figure 6:
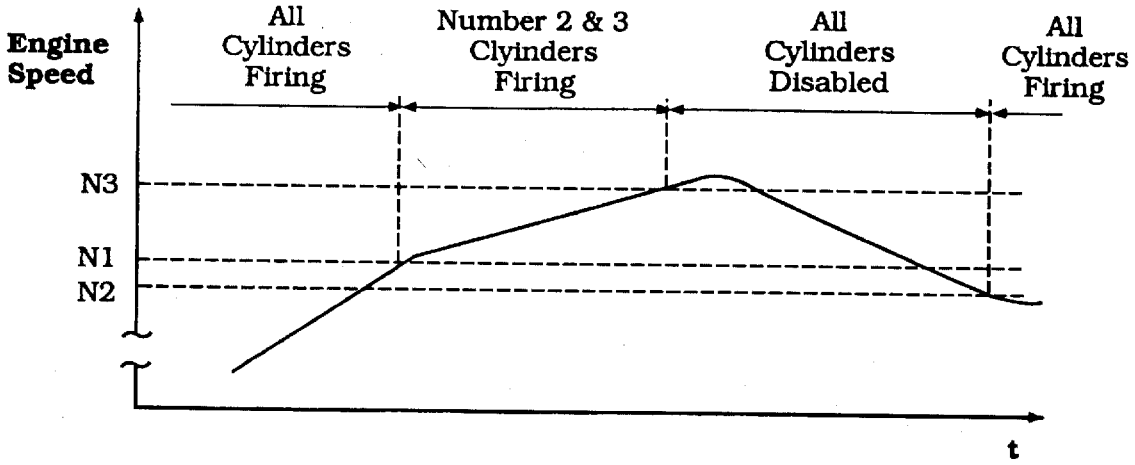
FIG. 6 is a further graphical view that is similar to FIG. 5.

This operation is illustrated in FIGS. 5 and 6. If an abnormal condition is detected by one of the sensors 66, and the engine is operating at an engine speed N2 that is less than the maximum permitted abnormal condition engine speed N1, all cylinders will be permitted to operate. When, however, an engine speed greater than N1 is signalled to the ignition timing electronic control unit 65 by the engine speed sensor 75, the ignition timing electronic control unit 65 reduces the engine speed by curtailing ignition in the numbers 1 and 4 cylinders by no longer activating the upper ignition coil pair 68 shown in FIG. 4. This results in the engine speed decreasing to the N2 level at which point normal ignition is resumed in all four cylinders.

In FIG. 6, the example is illustrated where the engine is not curtailed sufficiently by disabling ignition in the numbers 1 and 4 cylinders. Instead and for some reason, the engine speed continues to increase up to a higher N3 level at which point the ignition timing electronic control unit 65 curtails ignition in all cylinders, essentially shutting down the engine 12 until its rotational speed is reduced to the N2 level at which point normal engine operation is resumed.

The order in which the ignition control system 64 disables the cylinders 32 will now be discussed in detail. As previously stated and with reference to FIG. 1–3, the exhaust gases from the cylinders 32 are routed through the exhaust system 51 to a common discharge 58 which discharges the exhaust gases through the hub 59 of the propeller 22. A significant back pressure is associated with such underwater discharge systems which must be overcome by the exhaust gases in order to properly exhaust through the underwater discharge 58.

During normal engine operation, the exhaust gases consist of burnt charge which exits each cylinder 32 during its exhaust stroke at an exhaust pressure sufficiently high to overcome the underwater exhaust back pressure. This is not the case, however, for the exhaust gases exiting a cylinder 32 whose ignition has been curtailed by the ignition timing electronic control unit 65 due to an abnormal engine running condition as is shown in FIG. 7. In this case, the intake charge fills the cylinder 32 during its intake stroke and is compressed normally. However, since ignition is curtailed, the pressure of the unburnt charge will drop below the pressure in the exhaust port 42 during the expansion stroke which will result in reverse flow occurring in the subsequent exhaust stroke for the cylinder 32. This will adversely effect the performance of the engine 12 since the reverse flow in the cylinder 32 will have a negative impact on the air fuel charging system for the engine 12 and result in rough engine operation.

This negative consequence of curtailing the ignition of some of the cylinders 32 can be minimized by disabling the cylinders in a preferential order as is shown in FIG. 8*a* where the numbers 1 and 4 cylinders are operating with their ignition curtailed by the ignition timing electronic control unit 65. In this instance, the reverse flow into the number 1 cylinder during its exhaust stroke is significantly restricted since the back pressure exhaust gases present in the exhaust manifold 52 are unable to reach the number 1 cylinder due to the continued normal operation of cylinders 2 and 3. Additionally, the normal operation of cylinders 2 and 3 also reduces the reverse flow into the number 4 cylinder, though not to the same extent as the number 1 cylinder.

Figure 9:
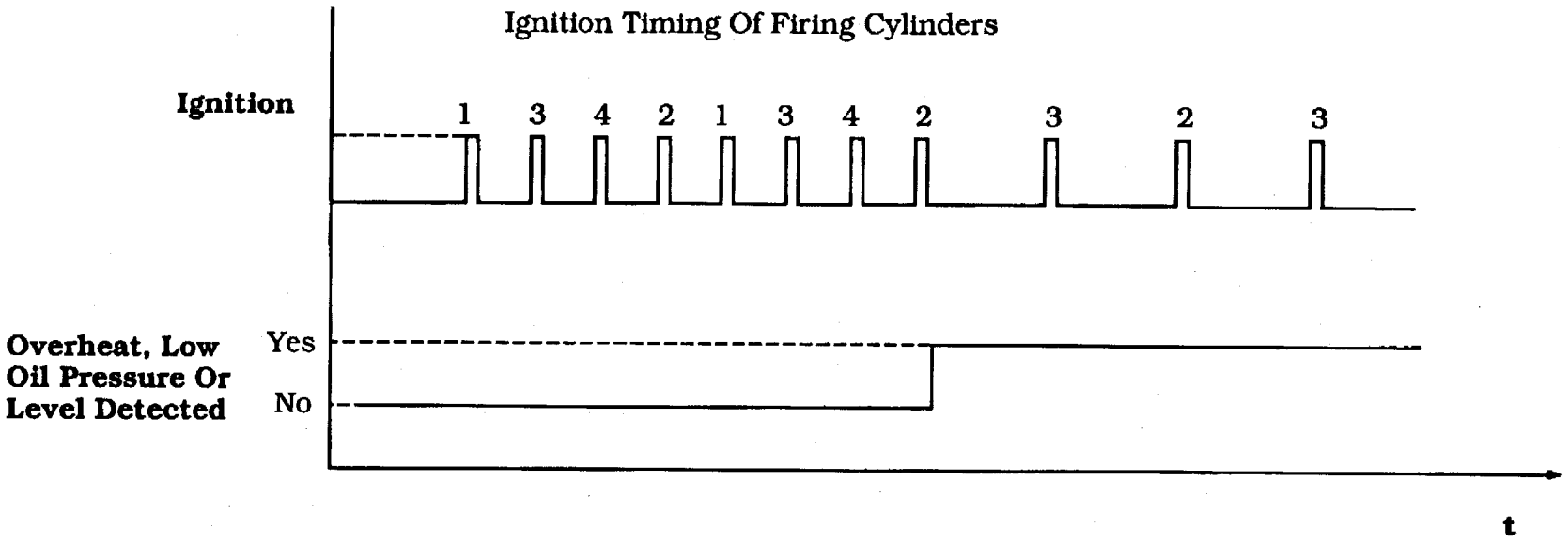
FIG. 9 is a graphical view showing a control routine.

FIG. 8*b* illustrates the example where the ignition of the numbers 2 and 3 cylinders is curtailed. This configuration is inferior to the configuration of FIG. 8*a* since the reverse flow into the cylinders 2 and 3 during their exhaust strokes is not significantly curtailed by the normal operation of cylinders 1 and 4. Thus, it is readily apparent that curtailing the ignition first in the numbers 1 and 4 cylinders as shown in FIGS. 8*a* and graphically in FIG. 9 minimizes the adverse effects of reduced speed engine operation caused by an abnormal engine running condition.

Figure 10:
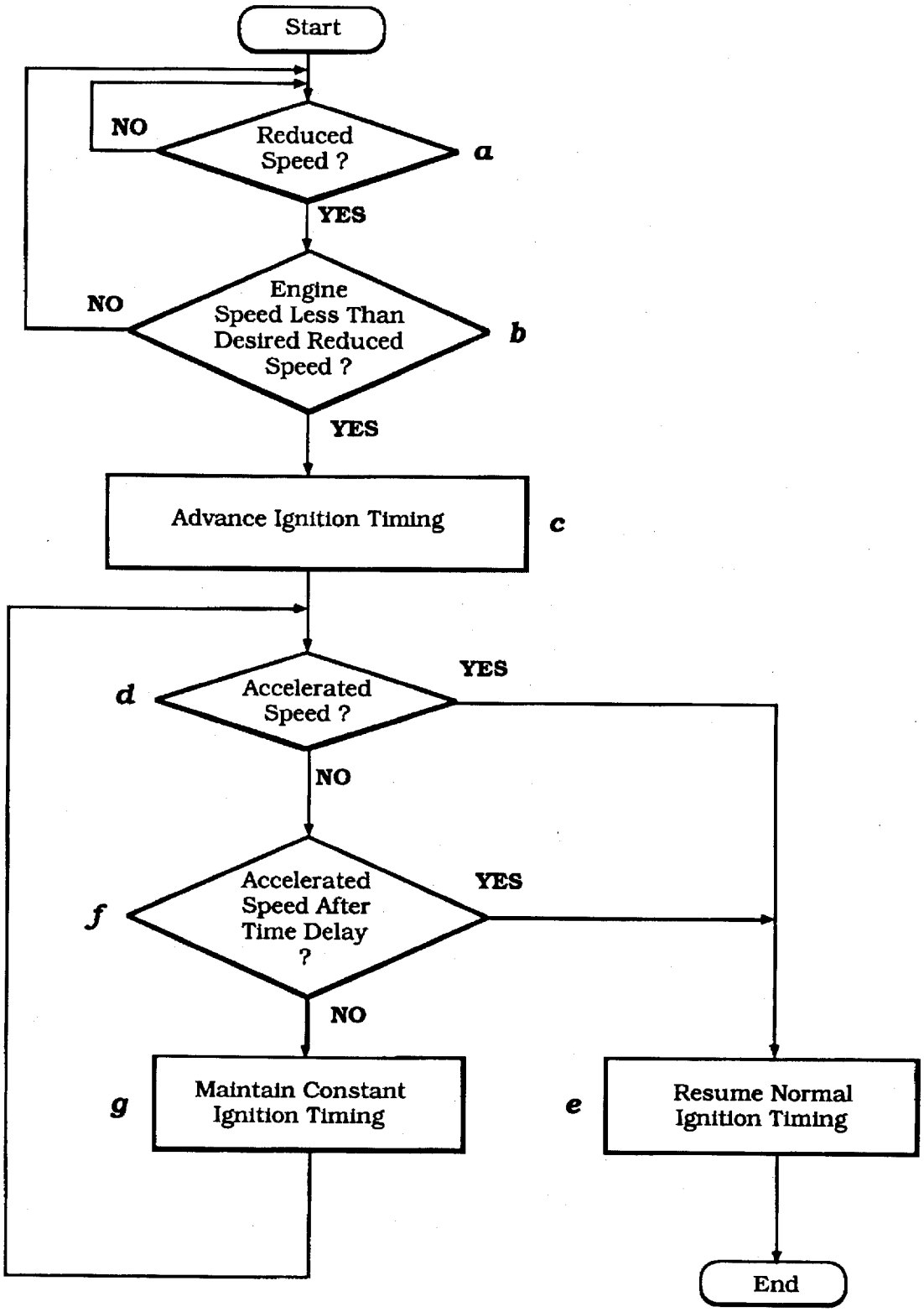
FIG. 10 is a flow chart that shows an ignition control sequence for the engine in accordance with an embodiment of the invention.

In addition to curtailing ignition of one or more cylinders 31 when an abnormal engine running condition is detected, the ignition control system 64 also adjusts the ignition timing of the firing cylinders so as to cause the engine 12 to rotate at the desired reduced engine speed in as smooth a manner as possible. The control sequence used to accomplish this will be described by reference to FIG. 10.

The sequence starts and goes to step "a" where it is determined if the engine 11 is operating at a reduced speed and with one or more cylinders 32 disabled. If the engine 12 is not operating at a reduced speed by the cylinder disabling, step a will repeat until such time as the ignition timing electronic control unit 65 disables one or more cylinders 32 thus causing the engine 12 to operate at a reduced speed at which point the control sequence proceeds to step "b".

At step "b" it is determined if the engine speed is less than the desired reduced engine speed. If this is not the case, the sequence returns to step "a" and repeats.

If the engine speed is less than the desired reduced engine speed at step "b", the sequence proceeds to step "c" where the ignition timing electronic control unit 65 determines the ignition timing necessary for smooth engine operation at the desired reduced speed and advances the ignition timing accordingly from its normal reduced speed setting.

The sequence then proceeds to step "d". In step "d" the ignition timing electronic control unit 65 determines if the condition is such that the engine has increased. If this is so then the sequence proceeds to step "e" where the ignition timing is returned to its normal setting and the control sequence terminates.

If the engine 12 is not operating at some speed in excess of the desired reduced speed, the sequence goes to step "f" where after a predetermined time period the ignition timing electronic control unit 65 again checks that the engine 12 is operating in excess of the reduced speed. If this is so the sequence once again proceeds to step "e", described above. Otherwise the sequence proceeds to step "g" where the ignition timing is held constant.

Following this, the control sequence returns to step "d" and continues to repeat until such time as the engine operating conditions determined in steps "d" and "f" causes the control sequence to proceed to step E and thus terminate. Thus, it is seen that the above control sequence adjusts the firing of the non-disabled cylinders 32 such that the engine 12 operates smoothly at the desired reduced speed.

During engine startup it is desirable to operate the engine 12 at a higher engine speed. Also some of the sensor outputs may indicate an abnormal condition which may not really exist. For example, the oil pressure may read low because of the low engine temperature. Alternately the engine temperature may read high only because the thermostat is temporarily closed. Thus an immediate speed reduction may not be either necessary or desirable during an engine warmup period.

Figure 11:
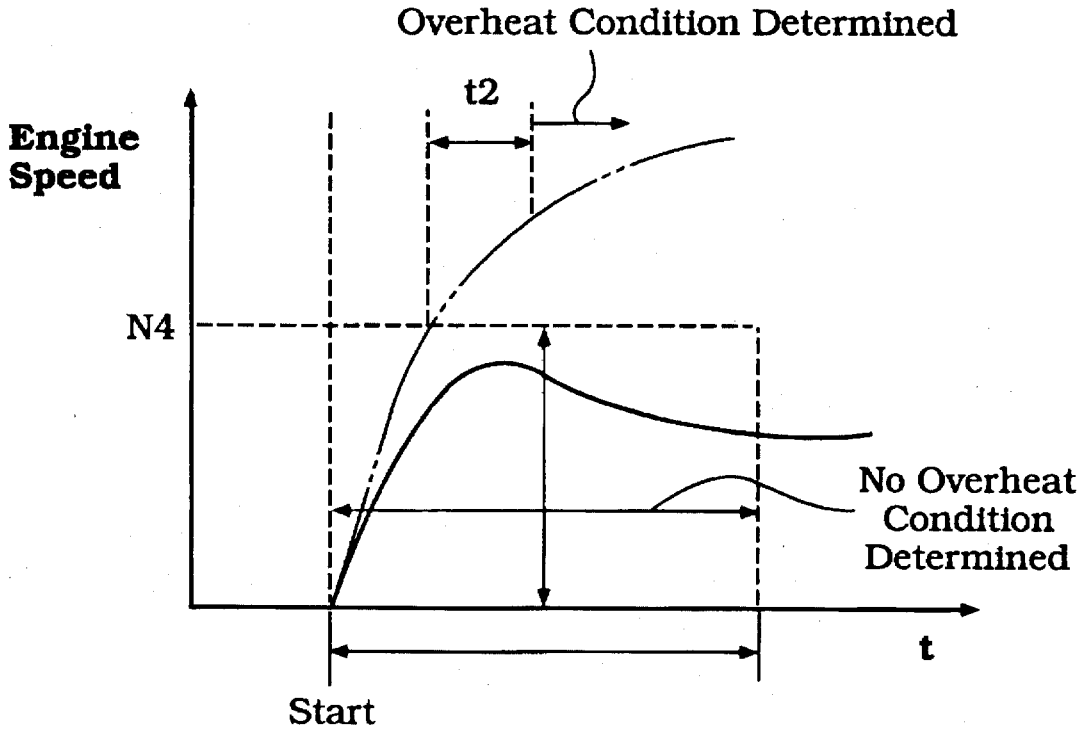
FIG. 11 is a graphical view that shows an embodiment of the invention.

It is possible, however, for a newly started engine 12 to reach a speed where speed reduction is called for if an abnormal condition is indicated as shown by the dashed line curve of FIG. 11. This may be a false abnormal condition for an engine that is not yet fully warmed up. Under this condition speed reduction is not initiated immediately. An embodiment of this invention distinguishes between an engine running under abnormal conditions and a not yet fully warmed up engine that is temporarily indicating abnormal operating conditions by incorporating a timer (not shown) into the ignition control system 64 to enforce a delay period between the time an abnormal engine running condition is detected and the time the ignition timing electronic control unit 65 begins disabling cylinders.

As seen in FIG. 11, the timer is activated when the engine speed exceeds the N4 level that is indicative of an engine running in an abnormal condition. If after the time period t2 has elapsed the engine 12 is still operating with an engine speed in excess of N4, then an overheat condition is signaled by the engine overheat sensor 72 to the ignition timing electronic control unit 65 which will then begin disabling cylinders 32 in order to reduce the engine speed. If, on the other hand, the engine 12 is operating with an engine speed which is less than N4 after the t2 time period, then no abnormal condition is signaled to the ignition timing electronic control unit 65 and the engine 12 continues to operate normally.

Figure 12:
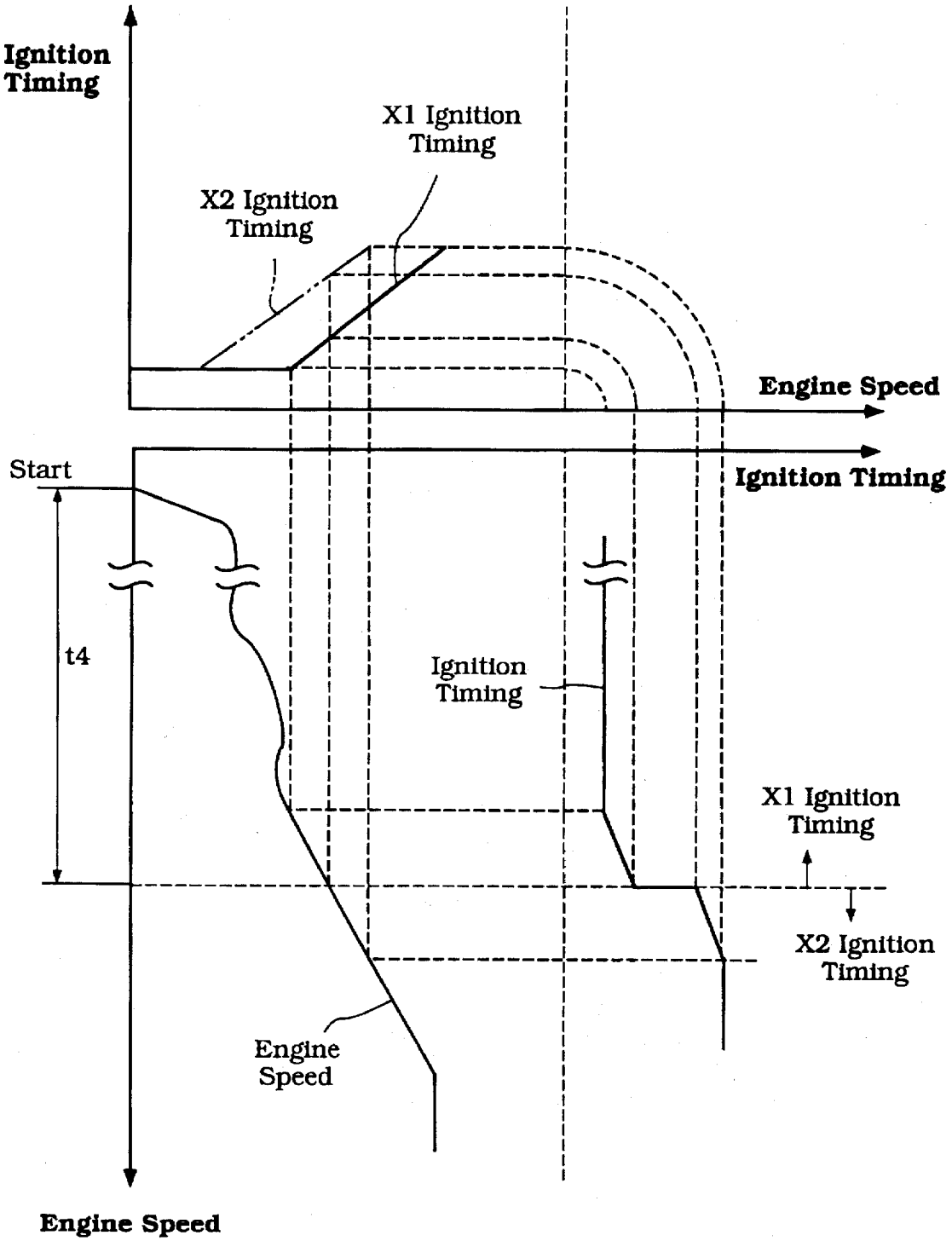
FIG. 12 is a graphical view that shows a further embodiment of the invention.

FIG. 12 illustrates a further embodiment of the invention where two ignition control sequences are utilized by the ignition control system 64 during engine startup in order to more quickly warm the engine up. In this embodiment, an initial X1 timing is used which delays the beginning of the spark advance curve for a period t4 after initial engine start up. This has the effect of more rapidly warming the engine up to its minimum operating temperature which is reached upon termination of the t4 time period.

This is done by initially selecting the advance curve X1 upon initial engine running after start up. The curve X1 has the same advance slope in the illustrated embodiment as the normal advance curve X2 but begins at a higher speed as shown in the upper, rotated view of this figure.

Thus upon starting and before the time period t4 has elapsed the timing curve X1 is used. After the t4 time period has elapsed, the ignition control system 64 then utilizes the X2 ignition timing which advances the ignition timing to its normal engine operating settings.

Figure 13:
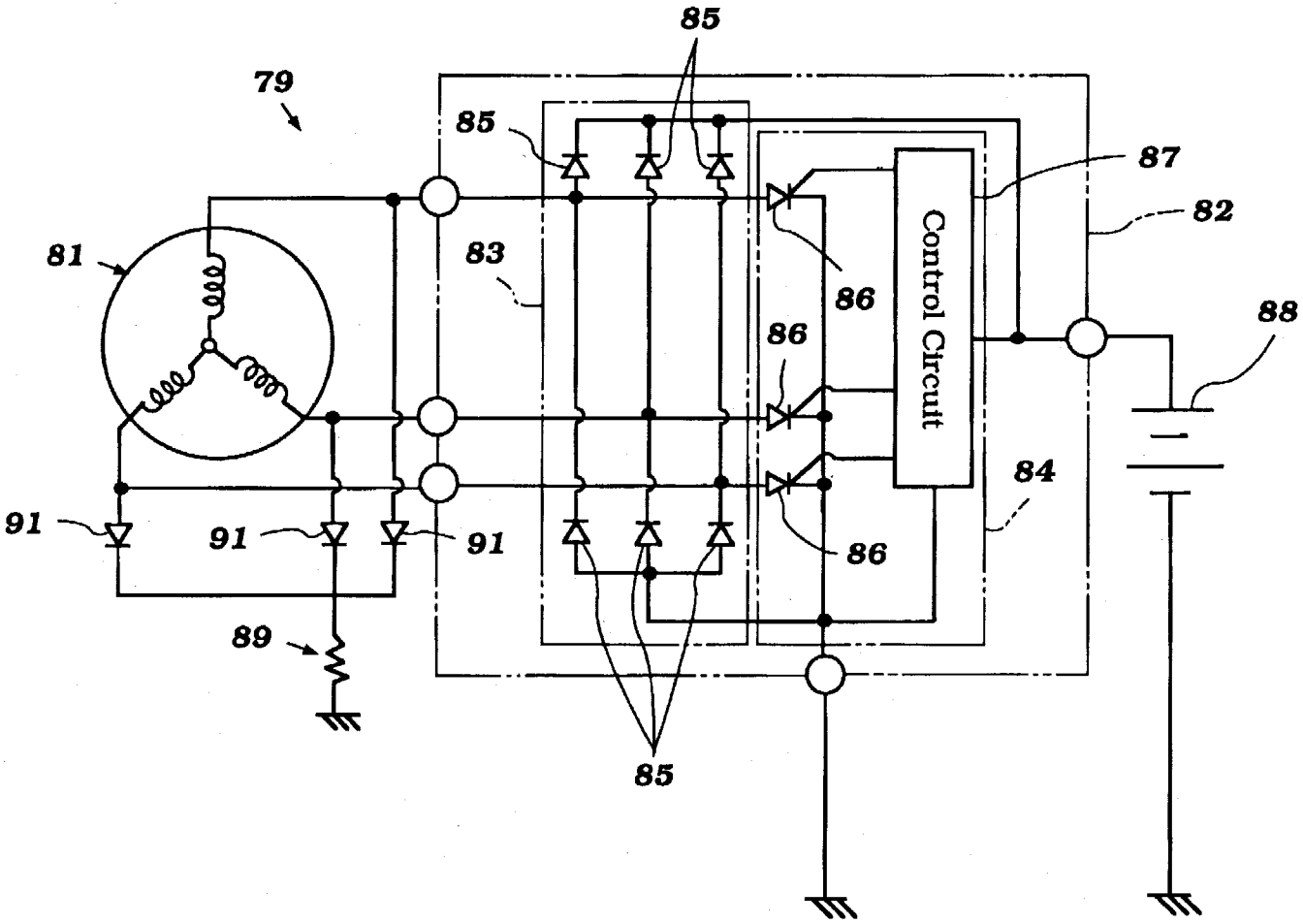
FIG. 13 is a schematic view of a powering circuit for the outboard motor and shows an embodiment of the invention.

A further embodiment of the invention consisting of a power circuit that is indicated generally by the reference numeral 79 and in which a choke heater is used to facilitate control during engine warmup is illustrated in FIG. 13. An indirect current three-way coil power source is indicated by the reference numeral 81 and connected to a rectifier regulator assembly 82. The rectifier regulator assembly 82 consists of a voltage rectifier 83 and a voltage regulator 84. The voltage rectifier 83 is composed of a series of rectifiers 85 while the voltage regulator 84 is composed of transistors 86 that are controlled by a control circuit 87 which in turn is connected to a battery 88. The choke heater is indicated by the reference numeral 89 and is connected to the three-way coil power source 81 through rectifier elements 91.

Indirect current generated by the three-way coil 81 is converted to direct current by the voltage rectifier 83 and subsequently regulated by the voltage regulator 84 and used to charge the battery 88. Indirect current from the three-way coil 81 is also converted to direct current by the rectifier elements 91 and used to power the choke heater 89.

Figure 14:
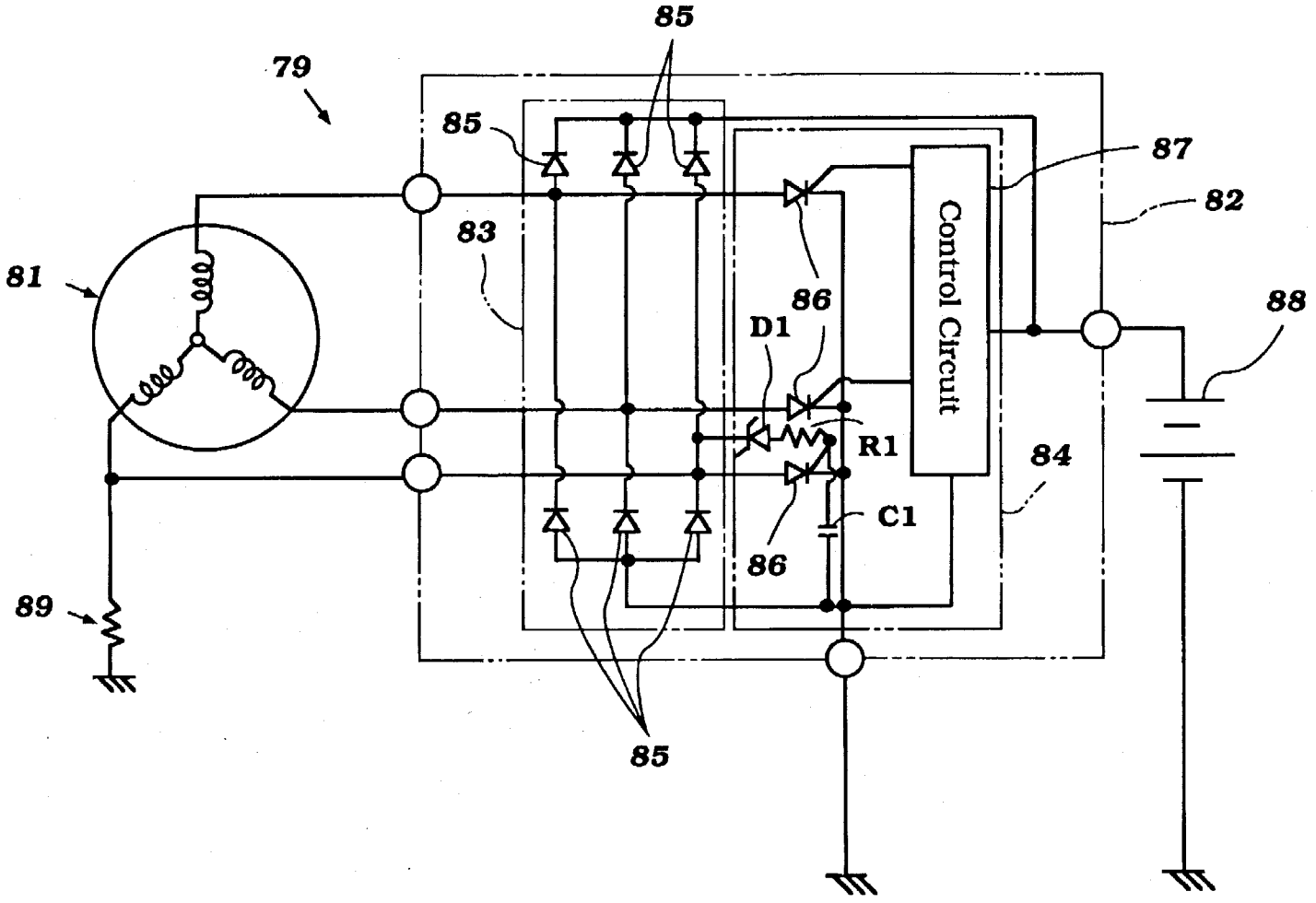
FIG. 14 is a schematic view of a powering circuit similar to FIG. 13 and shows another embodiment of the invention.

A problem exists with the above circuit 79 in that sufficient current is not always available to the choke heater 89 when the rectifier regulator assembly 82 is charging the battery 88. This problem is eliminated by a further embodiment of the invention that is shown in FIG. 14 and comprises a new power circuit that is indicated by the reference numeral 101. In this circuit the choke heater 89 is directly connected to one of the coils of the three-way coil 81 while the voltage regulator 84 connects to the voltage rectifier 83 through a resistor R1, diode D1, and condenser C1. The resistor R1 is connected to the output side of the voltage rectifier 83 through the diode D1 while the condenser C1 connects to the input side of the rectifier 83. With this configuration, no voltage regulation occurs in the one coil that powers the choke heater 89 which thus has sufficient power available to facilitate engine warmup.

Figure 15:
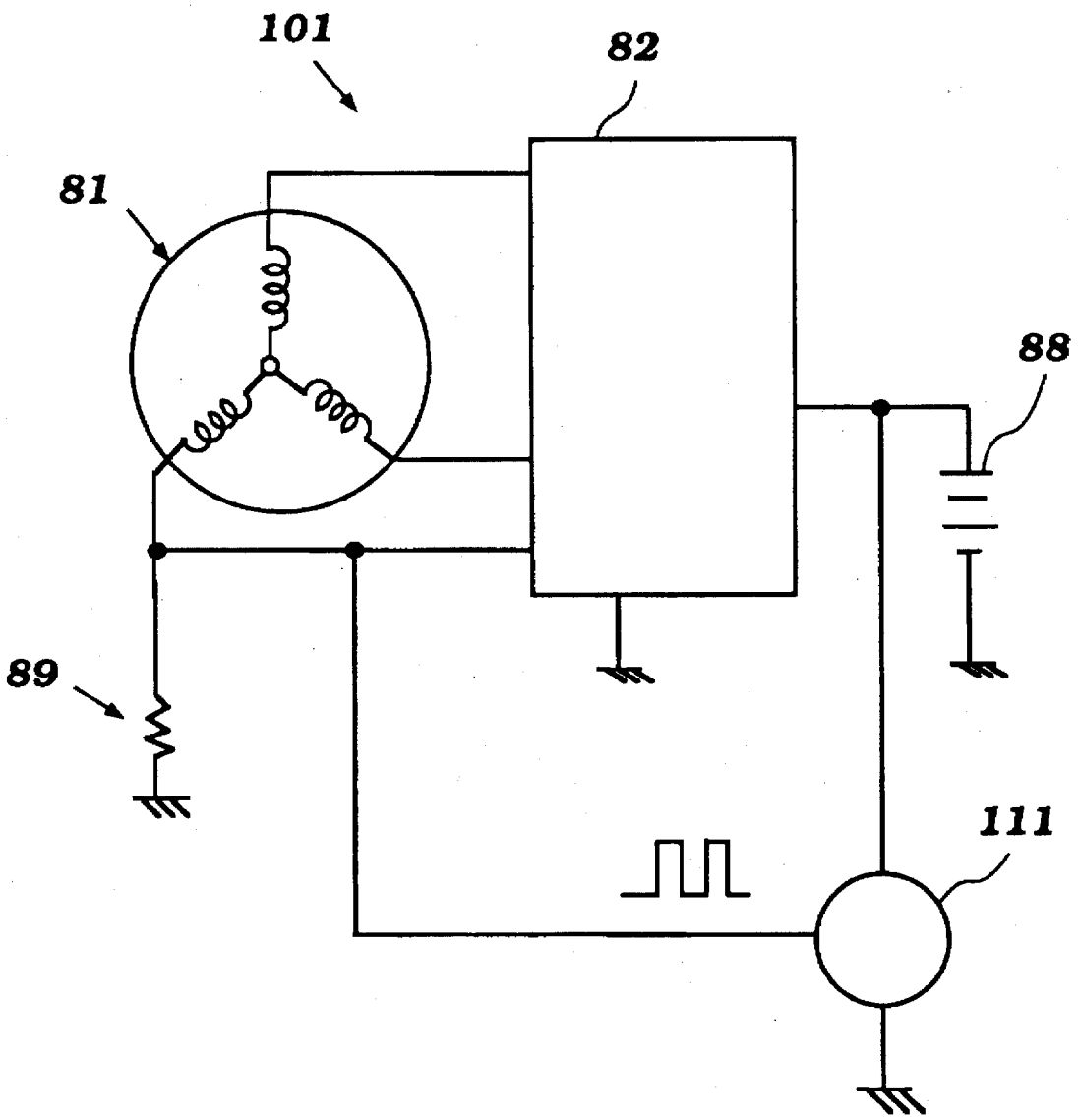
FIG. 15 is a schematic view of the powering circuit of FIG. 14 that is modified to include a further embodiment of the invention.

Another embodiment of the invention is illustrated in FIG. 15 in which a tachometer 111 is driven off the output pulse of the choke heater 89 of the previous embodiment.

It should be readily apparent from the foregoing description that the described embodiments of the invention, are very effective in providing good engine control and engine protection by reducing engine speed in the event of abnormal conditions by disabling the firing of certain cylinders. The cylinders which are disabled are chosen depending on their vertical positioning or distance from exhaust discharge so as to obtain smoother running and avoid problems. In addition, during start-up the disabling is not initiated unless the engine speed is above a predetermined speed for longer than a predetermined time period. Of course, the foregoing description is that of preferred embodiments of the invention and various changes and modifications may be made without departing from the spirit and scope of the invention, as defined by the appended claims.

What is claimed is:

1. An engine and control system for an outboard motor, said engine having a plurality of cylinders each extending horizontally and disposed in vertically spaced relationship, an air fuel charging system for supplying an air fuel charge to said engine for combustion in said engine, an ignition system for igniting the air fuel charge in said cylinders, each of said cylinders being served by at least one exhaust port, an exhaust system for collecting the exhaust gases from said exhaust ports and delivering them to the atmosphere through a common discharge, an engine protection system comprising a sensor for sensing an abnormal engine condition, and a control system for reducing the engine speed in response to the sensing of an abnormal condition by said sensor by controlling one of said systems for precluding combustion in certain of said cylinders, the cylinder in which combustion is precluded being selected depending upon the vertical orientation relative to the other cylinders.

2. An engine and control system as set forth in claim 1 wherein combustion in the uppermost cylinder is precluded if this will give sufficient speed reduction.

3. An engine and control system as set forth in claim 2 wherein combustion in the lowermost cylinder is also precluded if disabling combustion in the uppermost cylinder is insufficient to provide sufficient speed reduction.

4. An engine and control system as set forth in claim 3 wherein combustion in cylinders between the uppermost and lowermost cylinders is also precluded if discontinuance of combustion in the uppermost and lowermost cylinders does not provide adequate speed reduction.

5. An engine and control system as set forth in claim 4 wherein combustion in the uppermost cylinder is precluded on more cycles than in the remaining cylinders.

6. An engine and control system as set forth in claim 1 wherein the engine further includes a starter for starting the engine and wherein the control includes a timer for measuring time, if the engine speed is above a predetermined engine speed when the abnormal condition is sensed at a less than predetermined time after engine starting, the disablement of combustion is not initiated until after a predetermined time interval.

7. An engine and control system as set forth in claim 6 wherein combustion in the uppermost cylinder is precluded if this will give sufficient speed reduction.

8. An engine and control system as set forth in claim 7 wherein combustion in the lowermost cylinder is also precluded if disabling combustion in the uppermost cylinder is insufficient to provide sufficient speed reduction.

9. An engine and control system as set forth in claim 8 wherein combustion in cylinders between the uppermost and lowermost cylinders is also precluded if discontinuance of combustion in the uppermost and lowermost cylinders does not provide adequate speed reduction.

10. An engine and control system as set forth in claim 9 wherein combustion in the upper most cylinder is precluded on more cycles than in the remaining cylinders.

11. An engine and control system as set forth in claim 1 wherein the common discharge of the exhaust system is disposed below the level of water in which the outboard motor is operating.

12. An engine and control system as set forth in claim 11 wherein combustion in the uppermost cylinder is precluded if this will give sufficient speed reduction.

13. An engine and control system as set forth in claim 12 wherein combustion in the lowermost cylinder is also precluded if disabling combustion in the uppermost cylinder is insufficient to provide sufficient speed reduction.

14. An engine and control system as set forth in claim 13 wherein combustion in cylinders between the uppermost and lowermost cylinders is also precluded if discontinuance of combustion in the uppermost and lowermost cylinders does not provide adequate speed reduction.

15. An engine and control system as set forth in claim 14 wherein combustion in the uppermost cylinder is precluded on more cycles than in the remaining cylinders.

16. An engine and control system as set forth in claim 11 wherein the common discharge of the exhaust system is disposed below the level of water in which the outboard motor is operating further including a restricted above the water exhaust gas discharge communicating with all of the exhaust ports.

17. An engine and control system as set forth in claim 1 wherein the sensor senses one of the conditions of abnormal engine temperature, abnormal engine lubricating conditions, and excessive engine speed.

18. An engine and control system as set forth in claim 17 wherein the sensor senses abnormal engine temperature.

19. An engine and control system as set forth in claim 17 wherein the sensor senses abnormal lubricant condition.

20. An engine and control system as set forth in claim 19 wherein the sensor sense lubricant pressure.

21. An engine and control system as set forth in claim 19 wherein the sensor senses lubricant level.

22. An engine and control system as set forth in claim 17 wherein the sensor senses excessive engine speed.

23. An engine and control system as set forth in claim 18 wherein the engine further includes a starter for starting the engine and wherein the control includes a timer for measuring time, if the engine speed is above a predetermined engine speed when the abnormal condition is sensed at a less than predetermined time after engine starting, the disablement of combustion is not initiated until after a predetermined time interval.

24. An engine and control system as set forth in claim 1 wherein the system control to preclude combustion is the ignition system and combustion is precluded by not firing the spark plug associated with the cylinder in which combustion is to be precluded.

25. An engine and control system as set forth in claim 24 wherein the timing of the remaining of the firing of the remaining cylinders is adjusted when the firing of the spark plug of one of the cylinders is disabled.

26. An internal combustion engine and control system said engine having a plurality of cylinders, an air fuel charging system for supplying an air fuel charge to said engine for combustion in said cylinders, an ignition system for igniting the air fuel charge in said cylinders, a starter for starting said engine, a sensor for sensing an abnormal engine condition, a control for reducing engine speed in response to the sensing of an abnormal engine condition by controlling one of said systems for precluding combustion in only certain of said cylinders, while continuing combustion in the remaining cylinders, and means for delaying the preclusion of combustion in response to the sensing of an abnormal condition if the engine has been initially started until more than a predetermined time period of the abnormal condition has elapsed.

27. An engine control method for an outboard motor, said engine having a plurality of cylinders each extending horizontally and disposed in vertically spaced relationship, an air fuel charging system for supplying an air fuel charge to said engine for combustion in said engine, an ignition system for igniting the air fuel charge in said cylinders, each of said cylinders being served by at least one exhaust port, an exhaust system for collecting the exhaust gases from said exhaust ports and delivering them to the atmosphere through a common discharge, said method comprising the steps of sensing an abnormal engine condition and reducing the engine speed in response to the sensing of an abnormal condition by controlling one of said systems for precluding combustion in certain of said cylinders, the cylinder in which combustion is precluded being selected depending upon the vertical orientation relative to the other cylinders.

28. An engine control method as set forth in claim 27 wherein combustion in the uppermost cylinder is precluded if this will give sufficient speed reduction.

29. An engine control method as set forth in claim 28 wherein combustion in the lowermost cylinder is also precluded if disabling combustion in the uppermost cylinder is insufficient to provide sufficient speed reduction.

30. An engine control method as set forth in claim 29 wherein combustion in cylinders between the uppermost and lowermost cylinders is also precluded if discontinuance of combustion in the uppermost and lowermost cylinders does not provide adequate speed reduction.

31. An engine control method as set forth in claim 30 wherein combustion in the uppermost cylinder is precluded on more cycles than in the remaining cylinders.

32. An engine control method as set forth in claim 31 wherein combustion in the lowermost cylinder is also precluded if disabling combustion in the uppermost cylinder is insufficient to provide sufficient speed reduction.

33. An engine control method as set forth in claim 32 wherein combustion in cylinders between the uppermost and lowermost cylinders is also precluded if discontinuance of combustion in the uppermost and lowermost cylinders does not provide adequate speed reduction.

34. An engine control method as set forth in claim 33 wherein combustion in the upper most cylinder is precluded on more cycles than in the remaining cylinders.

35. An engine control method as set forth in claim 27 wherein the common discharge of the exhaust system is disposed below the level of water in which the outboard motor is operating.

36. An engine control method as set forth in claim 35 wherein combustion in the uppermost cylinder is precluded if this will give sufficient speed reduction.

37. An engine control method as set forth in claim 36 wherein combustion in the lowermost cylinder is also precluded if disabling combustion in the uppermost cylinder is insufficient to provide sufficient speed reduction.

38. An engine control method as set forth in claim 37 wherein combustion in cylinders between the uppermost and lowermost cylinders is also precluded if discontinuance of combustion in the uppermost and lowermost cylinders does not provide adequate speed reduction.

39. An engine control method as set forth in claim 38 wherein combustion in the uppermost cylinder is precluded on more cycles than in the remaining cylinders.

40. An engine control method as set forth in claim 27 wherein the common discharge of the exhaust system is disposed below the level of water in which the outboard motor is operating further including a restricted above the water exhaust gas discharge communicating with all of the exhaust ports.

41. An engine control method as set forth in claim 27 wherein the sensed condition is one of abnormal engine temperature, abnormal engine lubricating conditions, and excessive engine speed.

42. An engine control method as set forth in claim 41 wherein the condition sensed is abnormal engine temperature.

43. An engine control method as set forth in claim 41 wherein the condition sensed is abnormal lubricant condition.

44. An engine control method as set forth in claim 43 wherein the condition sensed is lubricant pressure.

45. An engine control method as set forth in claim 43 wherein the condition sensed is lubricant level.

46. An engine control method as set forth in claim 41 wherein the condition sensed is excessive engine speed.

47. An engine control method as set forth in claim 27 wherein the engine further includes a starter for starting the engine and if the engine speed is above a predetermined engine speed when the abnormal condition is sensed at a less than a predetermined time after engine starting, the disablement of combustion is not initiated until after a predetermined time interval.

48. An engine control method as set forth in claim 27 wherein the system control to preclude combustion is the ignition system and combustion is precluded by not firing the spark plug associated with the cylinder in which combustion is to be precluded.

49. An engine control method as set forth in claim 48 wherein the timing of the remaining of the firing of the remaining cylinders is adjusted when the firing of the spark plug of one of the cylinders is disabled.

50. An internal combustion engine control method, said engine having a plurality of cylinders, an air fuel charging system for supplying an air fuel charge to said engine for combustion in said cylinders, an ignition system for igniting the air fuel charge in said cylinders, a starter for starting said engine, said method comprising the steps of sensing an abnormal engine condition, reducing engine speed in response to the sensing of an abnormal condition by controlling one of said systems for precluding combustion in only certain of said cylinders while continuing combustion in the remaining cylinders, and delaying the preclusion of combustion in response to the sensing of an abnormal condition if the engine has been initially started until more than a predetermined time period of the abnormal condition has elapsed.

* * * * *